US005749104A

United States Patent [19]

Evans

[11] Patent Number: 5,749,104

[45] Date of Patent: May 12, 1998

[54] ERGONOMIC TOILET SEAT ASSEMBLY FOR ADULTS AND CHILDREN

[76] Inventor: Hank A. Evans, 3300 Rollingbrook #1018, Baytown, Tex. 77521

[21] Appl. No.: 439,039

[22] Filed: May 11, 1995

[51] Int. Cl.[6] ..... A47K 13/06

[52] U.S. Cl. ..... 4/239

[58] Field of Search ..... 4/235, 236, 239, 4/240

[56] References Cited

U.S. PATENT DOCUMENTS

| | | | |
|---|---|---|---|
| 1,701,115 | 2/1929 | McKinney | 4/235 |
| 2,221,991 | 11/1940 | Myers et al. | 4/239 |
| 2,333,732 | 11/1943 | Morris | 4/240 |
| 3,471,874 | 10/1969 | Dixon | 4/240 |

*Primary Examiner*—Charles E. Phillips
*Attorney, Agent, or Firm*—Bush, Riddle & Jackson

[57] ABSTRACT

A toilet seat assembly having a pivotal toilet seat and a pivotal toilet seat insert to overlie rear and side portions of the opening thereof to facilitate safe and effective use by children. A seat insert body defines an outer peripheral recess and a support shoulder for supported and positioned engagement with the inner peripheral portion of the toilet seat. The pivotal connection of the seat insert is separable when the seat insert is at a predetermined angle between its seated and upstanding positions. The tail piece and pivot connections of the seat insert provide a stop to position the seat insert at an over-center position when upstanding to prevent contact of the seat insert with the seat cover of the toilet seat assembly. The forward side edge portions of the seat insert body define outwardly facing angulated surfaces which locate the frontal contact points of the insert and the conventional toilet seat to minimize the possibility of pinching the child during use. The seat insert body forms outer peripheral channels to conduct accidentally spilled liquid between the seat insert body and the conventional toilet seat so that it will drain into the toilet.

11 Claims, 3 Drawing Sheets

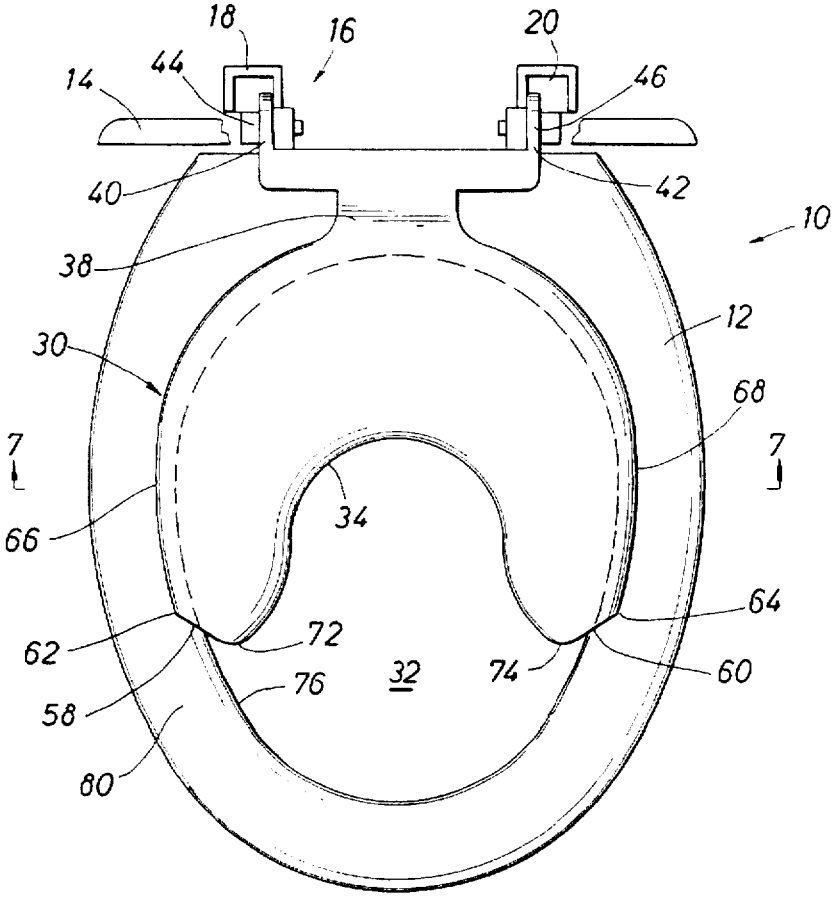
FIG. 1
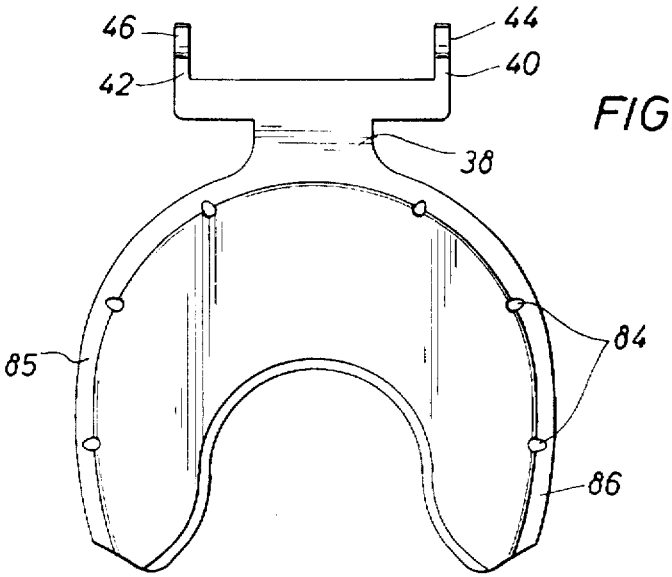
FIG. 2
FIG. 3
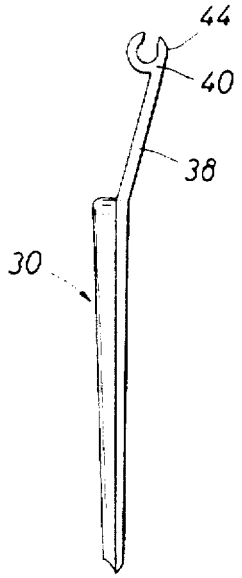
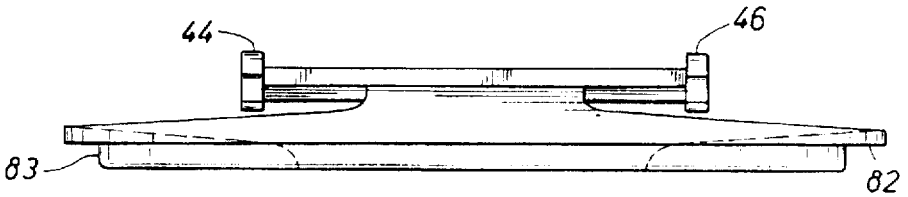
FIG. 4

FIG. 5
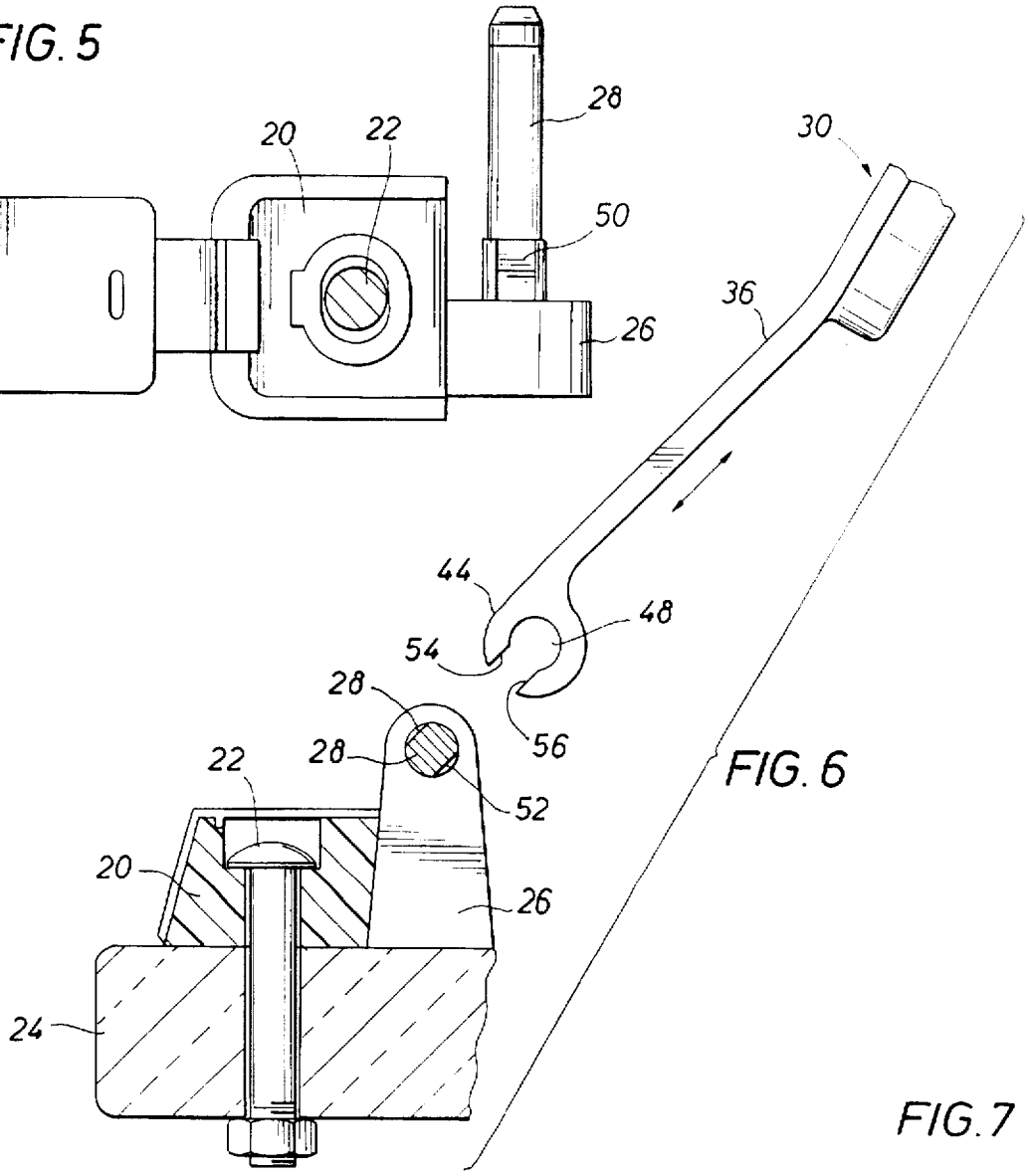
FIG. 6
FIG. 7
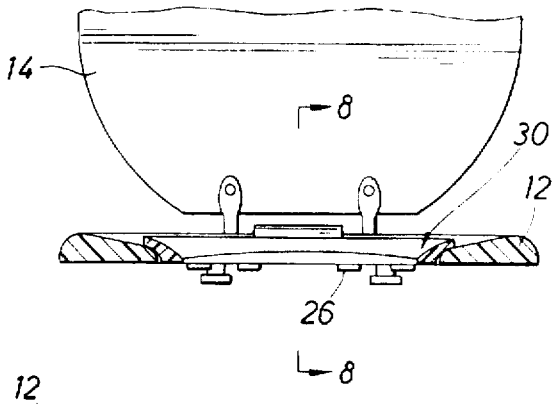
FIG. 8
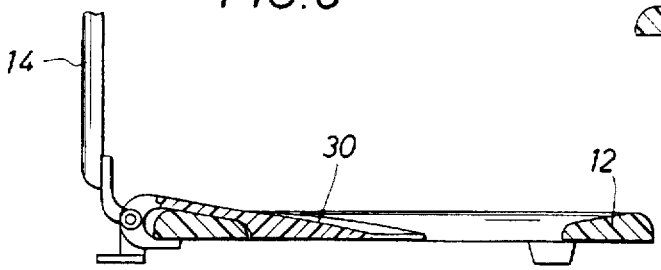

ERGONOMIC TOILET SEAT ASSEMBLY FOR ADULTS AND CHILDREN

FIELD OF THE INVENTION

The invention relates generally to toilet seat assemblies including the seats and covers thereof that are typically assembled to ceramic toilets for use in the domestic, commercial or institutional environment. More particularly, the present invention is directed to an ergonomic toilet seat assembly of a size that can be utilized by an adolescent or adult of normal size, and normal physical and mental capabilities as well as incorporates a design specific seat insert that is designed for pivotal assembly with the other components of the ergonomic toilet seat to selectively restrict the effective dimension of the opening thereof to facilitate use of the toilet by normal size adolescents and adults and to permit safe and effective use by children of a wide range of ages and adolescents or adults that are not of normal size, or lack normal physical and mental capabilities. This invention is also directed to a secondary toilet seat insert which may be pivotally moved to a position facilitating use of the ergonomic toilet seat by adults or may be separated from the toilet seat assembly for cleaning, for more efficient use of the toilet by adults or for any other purpose, without necessitating the use of any tools for its removal. This invention is also directed to providing an ergonomic toilet seat assembly whereby the individual component parts are specifically designed to interact and support the function and purpose of the seats other component parts, whereas the adult seat portion of the ergonomic seat assembly comprises areas of selected thickness and dimension so as to complement or enhance the features and function of the secondary seat insert. And whereas the hinge assemblies are specifically designed to provide support and pivotal movement of the adult seat portion, the hinge also incorporates a selected area directed to providing pivotal movement of the secondary seat insert's designed pivotal release openings. And to further represent the detailed interaction between the component parts, the seat's cover purposely contains a side-to-side contour that is opposite the side-to-side contour of the secondary seat insert so to minimize the potential for cross contamination between the secondary insert and the seats cover in the event the secondary insert becomes soiled by an adult or child during the use thereof. For the purpose of description, the term "child's seat" may be used to respectively indicate the secondary seat insert.

BACKGROUND OF THE INVENTION

In most cases domestic, commercial, and institutional bath facilities utilize toiletry apparatus that is designed particularly for use by normal adults. Adults and adolescents that do not qualify as normal because of size, health or poor physical and mental capabilities suffer various difficulties and are often injured while attempting to utilize toilet seat apparatus that is much too large for them. Additionally, the large size of conventional toilet seat apparatus makes it difficult for children to maintain effective sanitary conditions through use thereof because of the difficulty of positioning themselves with relation to the toilet seat and to utilize toilet paper for proper hygienic cleaning. Accordingly, it is considered desirable to provide ergonomic toilet seat assemblies of conventional design with pivotally movable inserts that permit toilets that are designed for use by adults to be effectively utilized by both adults and children of normal and impaired capabilities. A number of toilet seat inserts have been developed in the past, but for the most part these are of fairly complex and expensive nature and lack practical application in today's environments. It is desirable to provide an ergonomic toilet seat assembly that provides for effective and reliable use of toilets by children and yet the seat assembly may be obtained at reasonably low cost.

Removable toilet seat inserts have been provided to enable the safe and effective use of standard sized toilets by children. Some of these child's toilet seat inserts or adapters simply rest on the toilet seat and provide a toilet seat that is designed particularly for use by children. These removable seat insert devices are typically formed of molded polymer material and are seldom sufficiently durable for effective use over a long period of time or lack the construction that could support the weight of an impaired adult during the use thereof. Moreover, many removable children's toilet seats are not particularly stable when in assembly with a conventional toilet seat because very few manufactures use a consistent toilet seat opening size, and thus can move forwardly, backwardly and laterally to some degree when being used by a child. This factor causes many children's toilet seats to be susceptible to pinching the child as the apparatus is used. It is therefore desirable to provide an ergonomic toilet seat assembly that minimizes the possibility of pinching a child during its use. It is also desirable to provide an ergonomic toilet seat with a child's seat insert that ensures against contamination of toilet seat covers under circumstances where the inserts may have become soiled through use thereof by a child. It is further desirable to provide an ergonomic toilet seat providing a pivotally retained child's toilet seat insert that is capable of being easily assembled to or separated from its pivotal relation with a toilet seat assembly without necessitating the use of tools or special equipment to thus provide for ease of cleaning and to provide for simple and efficient temporary conversion of an ergonomic toilet seat for use by children. While providing a pivotally retained child's toilet seat insert that is capable of being easily removed without necessitating the use of tools it is further desirable to restrict or direct the aligned pivotal point of removal of the toilet seat insert so as to be at a point in the pivotal travel that is less that the raised position yet at a point higher than the pivotal halfway point for the purpose of eliminating the possibility of prematurely or unexpectedly dislodging the insert from about the pivot post during the initial point of pivotal movement from one position to the other. By providing a predefined point of pivotal removal that occurs in the pivotal travel process at a point less than the rested raised position yet higher that the half way point of travel the insert can perform without flaw in conditions and environments where proper pivotal procedures may not always be executed by its users.

SUMMARY OF THE INVENTION

It is a principle feature of the present invention to provide a novel ergonomic toilet seat assembly that consists of the comprised components of an adult sized seat cover, hinges and a child's toilet seat insert that may be placed in or removed from its pivotal assembly with the adult sized components of the ergonomic toilet seat and which may permit selective, safe and effective use of the toilet by both adults and children of normal or limited capabilities.

It is another important feature of this invention to provide as a component part of the ergonomic toilet seat a novel child's toilet seat insert that is designed to position contact areas between the seat insert and the conventional toilet seat so as to be relatively inaccessible by the skin tissues of a child to thus minimize the possibility of pinching the child during use.

It is another feature of this invention to address and correct the design deficiencies contained in domestic and commercial toilet seats that inherently create the problems for this segment of the general population which would include those that suffer from limited capabilities.

In addition, it is a feature of this invention to correct the ergonomic design deficiencies of toilet seat assemblies.

It is an even further feature of this invention to ergonomic toilet seat comprising a component part described as a novel toilet insert that is adapted to be pivotally connected to the ergonomic toilet seat hinge assembly, which is capable of being independently pivoted to a lowered position where it is supported for use by the toilet seat or independently pivoted to an upstanding position to permit unobstructed use of the toilet by adults.

It is an even further feature of this invention to provide a novel child's seat insert for hinged assembly with an ergonomic toilet seat and which can be effectively installed or removed from its hinged assembly at a relevant and apparent point in its course of movement without necessitating the use of tools or special equipment.

It is also a feature of this invention to provide a novel ergonomic toilet seat comprised of a seat cover and a novel child's toilet seat insert having combined relative positioning control that limits pivotal movement of the seat insert to a position preventing contact between the toilet seat insert and the underside of the the cover of the ergonomic toilet seat to thus maintain the sanitary condition of the ergonomic toilet seat assembly and eliminate any cross contamination from the child's seat to the underside of the seat's cover.

These and other features of the present invention are effectively realized according to the teachings hereof through the provision of a child's toilet seat insert having a seat insert body defining one or more downwardly and sidewardly facing under-side channels or recesses that define a peripheral shoulder for establishing supported and positioning engagement of the insert with the inner peripheral portion of a conventional toilet seat, whether of the oval domestic variety or of the split commercial variety. The seat insert body is designed for interfitting relation with the configuration of the toilet seat by which it is supported. The insert also defines a downwardly facing peripheral shoulder and a rounded peripheral edge about the side and rear portions thereof which effectively locate the contact area between the downwardly facing peripheral shoulder and the inner peripheral surface area of the adult sized toilet seat so that it is unlikely that the skin tissue of a child seated on the toilet can reach the contact area and become pinched. The child's seat insert is also provided with an elongate web or tail piece having hinge connection elements at the free extremity thereof which are adapted to be received the dedicated area of the ergonomic toilet seat's hinge assembly to establish pivotal connection of the seat insert. Thus, the seat insert of the present invention may be effectively utilized when the design process of toilet seat assemblies of both the domestic and commercial variety incorporates a child's toilet seat insert. The seat insert is also provided with hinges on the tail piece which, in addition to providing for pivotal raising and lowering of the insert, define hinge openings or receptacles that provide a "lift off" capability, allowing the insert to be installed in assembly with or removed from the toilet seat assembly by simple manual movement of the insert. For this purpose the pivot connection portion of the insert defines spaced flat surfaces at each pivot opening which, when positioned in registry with corresponding spaced flat surfaces of the hinge pins, permit the seat insert to be positioned in pivotal assembly with the hinge pins or removed from the hinge pins. The spaced flat surfaces of the hinge pins and the hinge openings are preferably oriented so that seat insert assembly to or removal from hinged assembly with the toilet seat can occur only at an intermediate pivotal position of the toilet seat insert. At its lowered or upstanding positions the seat insert will be retained in assembly with the hinge pins so that inadvertent separation of the seat insert from the hinge pins cannot occur. This "lift-off" hinge arrangement permits the toilet seat insert to be manually installed or removed without necessitating the use of tools or special equipment. The child's toilet seat insert can be efficiently removed from the toilet assembly for cleaning or to permit unobstructed use of the toilet by adults. The child's toilet seat insert may be assembled to the toilet seat at the time its use by a child is needed. At other times it may be stored in a cabinet adjacent the toilet or at any other suitable place of storage.

To minimize the possibility of pinching during use by children, the seat insert body defines forwardly extending portions on each side thereof having rearwardly and outwardly inclined outwardly facing surfaces which locate the forward most contact area between the seat insert and the conventional toilet seat rearwardly of the forward most part of the seat insert, which is identified herein as rearwardly recessed contact. This feature effectively minimizes the possibility that the skin tissues of the child, in engagement with the forward most part of the insert, can become located between the toilet seat and seat insert at the rearwardly recessed contact area and thus a child seated thereon is protected from becoming pinched during use of the device. The peripheral edges of the seat insert are rounded so that the contact area between the insert and the toilet seat at the sides and rear of the seat insert will also have an inwardly recessed location so that it will be unlikely that the child can be pinched between the toilet seat and seat insert at the side and rear portions of the seat insert.

The seat insert structure may be provided with a position locator such that at its maximum rearward position the main body portion of the seat insert will be disposed in spaced relation with a conventional toilet seat cover, thus preventing the toilet seat cover from becoming soiled or otherwise contaminated.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

FIG. 1 is a plan view of a toilet seat assembly including a conventional toilet seat and toilet seat cover and with a child's toilet seat insert constructed in accordance with the present invention and representing the preferred embodiment being disposed in pivotal assembly therewith.

FIG. 2 is a bottom view of the child's toilet seat insert of FIG. 1.

FIG. 3 is a side elevational view of the child's toilet seat insert of FIGS. 1 and 2.

FIG. 4 is a front elevational view of the child's toilet seat insert of FIGS. 1–3.

FIG. 5 is a plan view of one of the hinge fittings for the toilet seat insert of FIG. 1.

FIG. 6 is a partial exploded illustration of the toilet seat insert of FIGS. 1–4, showing the pivot pin in section and showing the intermediate pivotal position of the seat insert for assembly and disassembly thereof relative to the seat insert pivot.

FIG. 7 is a sectional view taken along line 7—7 of FIG. 1 and showing the seated relation of the seat insert relative to the toilet seat.

FIG. 8 is a sectional view taken along line 8—8 of FIG. 7.

Figure 9:
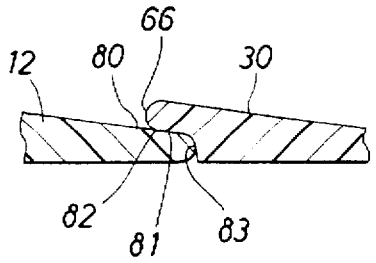

FIG. 9 is a fragmentary sectional view of the toilet seat assembly of FIGS. 1–4 illustrating the interfitting supported relation between the inner peripheral portion of a conventional toilet seat and the outer peripheral portion of the toilet seat insert.

Figure 10:
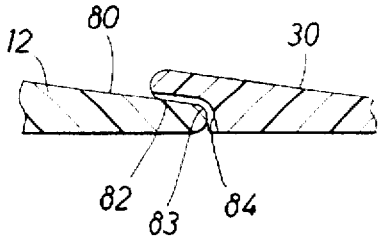

FIG. 10 is a fragmentary sectional view similar to that of FIG. 9, illustrating one of the drain channels of the toilet seat insert for drainage of liquid between the conventional toilet seat and the toilet seat insert.

Figure 11:
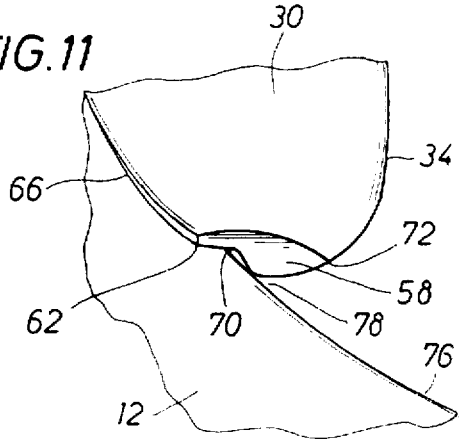

FIG. 11 is a partial isometric illustration of the conventional toilet seat and toilet seat insert illustrating the relieved forward portion of the toilet seat insert which minimizes the possibility of pinching.

Figure 12:
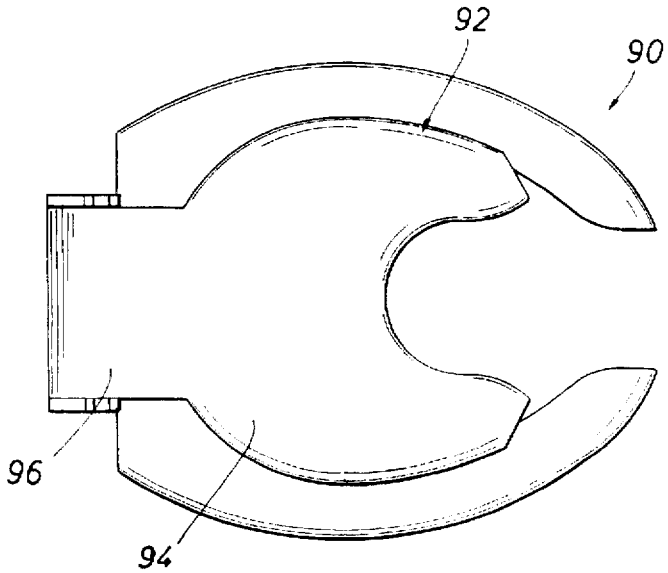

FIG. 12 is a plan view of a toilet seat assembly including a conventional toilet seat and toilet seat cover and with a child's toilet seat insert constructed in accordance with the present invention and representing an alternative embodiment being disposed in pivotal assembly therewith.

Figure 13:
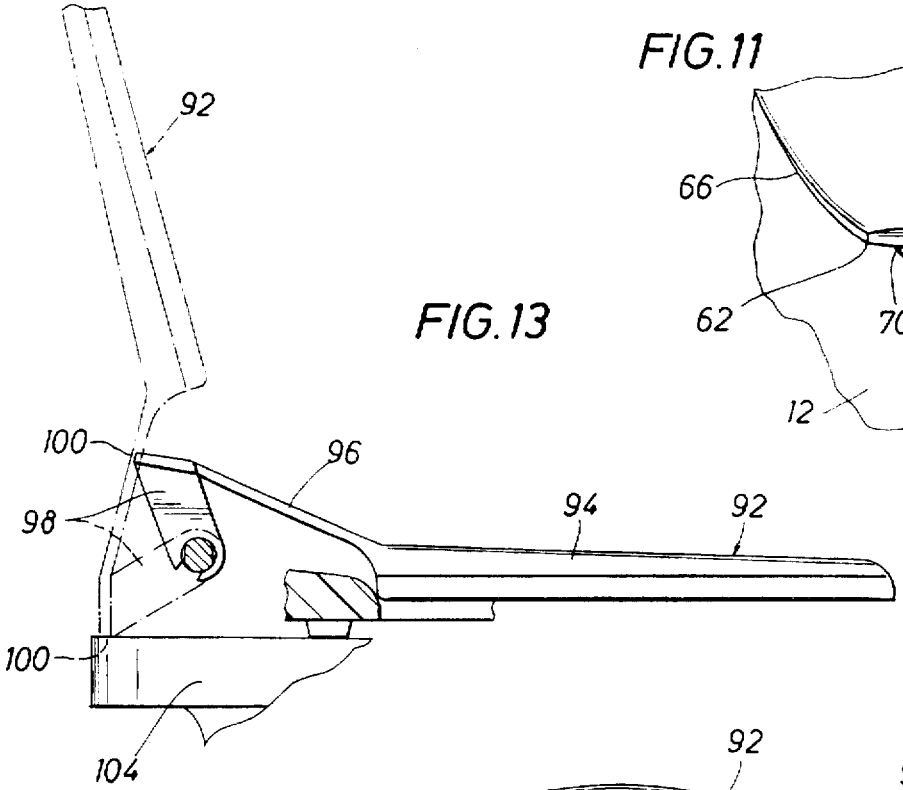

FIG. 13 is a side elevational view of the child's toilet seat insert of FIG. 12 shown in fill line and being shown in the upstanding and stopped position thereof in broken line.

DETAILED DESCRIPTION OF PREFERRED EMBODIMENT

Referring now to the drawings and first to FIG. 1, there is shown an ergonomic toilet seat assembly generally at 10 incorporating a toilet seat 12 and a toilet seat cover 14 that are assembled by means of a hinge assembly illustrated generally at 16. The hinge assembly, though providing for pivotal support of a ergonomic toilet seat and seat cover assembly on a conventional toilet, is also adapted for pivotal support of a removable child's toilet seat insert as will be discussed hereinbelow. In one ergonomic toilet seat arrangement, hinge fittings 18 and 20 shown in detail in FIGS. 5 and 6 are secured by screws, bolts 22 or by any other appropriate means to a conventional toilet 24, a part of which is shown at 24 in FIG. 5, and which may provide pivotal support for both the toilet seat and the seat cover. As shown in FIG. 6, each of the hinge fittings define a hinge projection 26 having a horizontally oriented hinge pin 28 that extends through registering pivot openings of respective hinge pin receptacles of the toilet seat and seat cover, thus permitting the toilet seat 12 and the toilet seat cover 14 to be disposed in hinged assembly with the toilet 24. As mentioned above, to adapt the toilet seat assembly for use by children, it is desirable to provide means for covering a rear portion of the toilet seat opening to define a smaller toilet opening that is suitable for children and to provide a seating surface that provides for safe and effective sanitary use of the toilet by children. For this purpose a removable child's toilet seat insert is provided, as shown generally at 30, which interfits with the adult sized toilet seat and minimizes the possibility of a child user being pinched during use of the toilet seat apparatus. It is further desirable to insure effective channeling of accidentally spilled liquid from the toilet seat apparatus and into the toilet and to minimize the possibility of contamination of the toilet seat cover as child's toilet seat insert is pivotally moved out of the way to permit use of the toilet seat by an adult. It is also desirable to provide a child's toilet seat insert that can be quickly and easily assembled to or disassembled from its pivotal relation with the toilet seat assembly without necessitating the use of tools or special equipment. The toilet seat insert device 30 will accomplish all of the features that are set forth above. The seat insert is positionable in supported and stabilized relation with an adult sized toilet seat as shown in FIG. 1, to overlie a portion of the adult sized toilet seat opening 32 and is selectively positionable at a raised or upstanding position to permit effective use of the adult sized toilet seat 12 by adults.

The toilet seat insert 30 is adapted for application to most toilet seats whether the upper surface thereof be rounded or substantially flat and inclined or tapered because the specific insert establishes supported engagement only with the inner peripheral surface portion of the toilet seat. The toilet seat insert 30 is defined by an insert body 32 having a configuration for substantially closing the rear portion of the toilet seat opening 30 and defining a smoothly curved front edge 34 having a configuration that cooperates with the specific configuration of the forward part of the toilet seat opening and results in a seat and seat opening configuration of ergonomic design that is suitable for use by children of a wide age range. The seat insert also cooperates with the configuration of the toilet seat to provide for effective stabilization of a child seated on the toilet seat and seat insert assembly. Although the upper surface of the insert body 32 may be of substantially planar configuration throughout most of its front to rear width, it may take other suitable forms, such as a gently curved or contoured configuration, for example, to provide for the comfort of the child during use. Further, although the front edge 34 is shown to be of arcuate configuration defining a rather large radius of curvature, it may take other suitable forms to provide for stability of the child user without departing from the spirit and scope of the present invention. Additionally, the insert body 30 may be tapered from a thick dimension at its rear portion 36 to a less thick dimension at the front edge 34. This feature enhances the ability of the children to properly position themselves with respect to the small dimension of the remaining part of the seat opening 32.

To provide for pivotal connection of the toilet seat insert 30 to the hinge assembly of the toilet seat, an integral connection web or tail piece 38 projects rearwardly from the seat insert body 30 and defines a pair of spaced hinge projections 40 and 42 that define hinge connections 44 and 46 respectively. The hinge connections define hinge openings such as shown at 48 in FIG. 6, which are adapted to receive the aligned hinge pins 28 of the respective hinge fittings so as to render the toilet seat insert 30 pivotal about the hinge pins. The web or tail piece will overlie the rear portion of the toilet seat and may be of a straight or curved configuration as the case may be, conforming to the configuration of the upper surface of the toilet seat with which it is to be used. This feature permits the toilet seat insert to be positioned as shown in FIG. 1 for effective use by children, or to be pivoted upwardly and out of the way for use of the toilet seat by adults.

It is to be noted that the scope of this invention is not intended to be limited by the particular hinge construction that is employed for pivotal support of the child's toilet seat insert. Any suitable hinge structure may be employed to support and position the toilet seat insert, whether the hinge be a part of the conventional toilet seat assembly or whether it be specific to establish pivotal connection of the toilet seat insert to other structure of the toilet. For example, the toilet seat insert may be pivotally supported and positioned by a hinge assembly separate from the hinge assembly of the toilet seat. In the alternative, the toilet seat insert may be free from any structural connection with the toilet assembly and may be supported and positioned merely by its structurally interfitting relation with the toilet seat.

It is desirable to provide a child's toilet seat insert that, in addition to being pivotal to upstanding and vertical positions independently of the toilet seat, is also capable of being manually installed in pivotal assembly with the toilet seat or removed from pivotal assembly with the toilet seat without necessitating the use of tools or special equipment. Accordingly the seat insert is capable of being manually installed or removed when it is suitably positioned relative to its range of pivotal movement. As shown particularly in FIGS. 5 and 6, the pivot pins 28 of the hinge fittings 18 and 20 define access means comprising a pin segment having parallel flat surfaces 50 and 52 which are spaced apart by a distance less than the diameter of the hinge pins. These parallel flat surfaces may be oriented at any suitable angle with respect to the vertical and horizontal. As shown particularly in FIG. 5, the parallel flat surfaces are oriented at an intermediate angular position between the horizontal and vertical, for example, an angle of about 45 degrees. The hinge or pivot connections 44 and 46 each define access opening means comprising circular hinge openings 48 having a diameter sufficient to receive the large dimension of the hinge pins in close fitting pivotal relation therein. The hinge connections 44 and 46 further define opposed spaced internal parallel flat surfaces 54 and 56 which are spaced less than the diameter of the respective circular pivot opening, but spaced sufficiently to receive the flat surfaces 50 and 52 therebetween when the flat surfaces are in angular registry. To achieve angular registry of the flat surfaces of the hinge pins and the hinge connections of the seat insert as shown in FIG. 5, the seat insert is pivoted to its predetermined intermediate angular position, i.e., substantially 45 degrees. At this angular seat insert position the seat insert 30 may be moved toward the hinge pins for pivotal installation or away from the hinge pins for separation of the hinge connections from the hinge pins. At all angular positions of the flat surfaces of the hinge connections other than the predetermined intermediate positions the spaced flat surfaces 54 and 56 of the hinge connections will not pass over the pivot pin diameter and thus the seat insert cannot be separated from its pivotal relation with the pivot pins. Thus, such as for the purpose of cleaning, the seat insert is simply rotated about its hinge connection until the angular orientation of the spaced flat surfaces 54 and 56 are in angular registry with the flat surfaces 50 and 52 of the hinge pins. When this pivotal position has been achieved the seat insert is simply moved in a direction away from the hinge pins for its removal. It may then be cleaned without any risk of contaminating the seat assembly of the toilet. It is not intended that the approximately 45 degree angular orientation of the flat hinge pin surfaces be considered to limit the present invention. If desired, any other angular orientation of the flat surfaces of the hinge pins are desired, such may be accomplished within the spirit and scope of the present invention. For example, if the flat hinge pin surfaces are oriented vertically then the seat insert is simply moved vertically for its manual installation and removal relative to the hinge pins. It should be noted with respect to FIG. 13 in comparison with FIG. 6, that the configuration of the tail piece and the configuration of the pivot arrangement will control the manner by which manual assembly and removal of the seat insert can occur. For example, the pivot fitting for assembly with the toilet may define a pivot opening may having a pivot slot. In this case the pivot connectors of the seat insert may define a corresponding pivot pin arrangement having opposed, spaced flat surfaces that are oriented with the slot to permit assembly and disassembly of the seat insert with the toilet and toilet seat assembly.

It is desirable to provide a toilet seat insert of the character described and which also insures against the possibility of pinching when used by a child. Accordingly, the toilet seat insert 30 is of a particular design that locates the forward most contact areas of the insert to the conventional toilet seat so as to be substantially inaccessible by body tissues of the user. Thus, when a child is seated on the insert and toilet seat the body tissues of the child, even when the child moves about thereon, will not ordinarily be capable of reaching the contact area between the seat and seat insert and thus will not become pinched between the toilet seat and seat insert. According to the teachings of this invention, as shown particularly in FIGS. 1 and 2, the front, side portions of the seat insert 30 are angulated so as to provide opposed rearwardly and outwardly inclined side surfaces 58 and 60 that are disposed in rearwardly diverging relation and which establish a smooth radius of curvature as shown in 62 and 64 at the juncture thereof with curved side edges 66 and 68 of the insert. This feature is also illustrated byway of the partial isometric view of FIG. 11. By angulating the side surfaces 58 and 60 in this manner the initial forward most contact point 70 between the seat insert 40 and the upper surface of the toilet seat 12 as shown in FIG. 11 will be at a recessed or protected location by virtue of being located rearwardly of the spaced forwardly-extending pointed regions 72 and 74 of the seat insert. Thus the forwardly-extended pointed regions 72 and 74 of the seat insert are located in laterally and inwardly spaced relation with the curved inner edge 76 of the toilet seat. This causes the development of a triangular space or void 78 which makes the initial contact point 70 on each side of the seat insert to be located rearwardly of the point of intersection that would be established if the curvature of forward edge 34 were continued to intersection with the curved edge 76 of the toilet seat. Thus, when a child is seated the child's body will extend from the insert points 72 and 74 to the seat surface 80 in a manner that overlies the triangular space or void 78. Further the thickness of the seat insert at the forward contact points causes the body of the child to extend from the seat insert to the toilet seat surface without reaching the forward contact point 70. Thus the initial contact areas 81, as shown in FIG. 9, are so located that they cannot normally be reached by the body tissues of a child seated on the toilet seat and seat insert. This recessed or protected location of the contact point 70 is cooperatively defined by the intersecting orientation of the rearwardly diverging angulated side surfaces 58 and 60 with the inner curved surface 76 of the toilet seat and the spaced location of the upper surface of the seat insert above the upper surface of the toilet seat which occurs by virtue of the thickness of the seat insert at contact point 70 as is evident from FIGS. 9 and 11. As shown in FIG. 1 elongate narrow contact areas are established at each of the sides of the seat insert with respect to the toilet seat surface 80 adjacent the curved inner edge surface 76 of the toilet seat. The recessed or protected location of the forward contact points 70 is also ensured by the structural relationship of the curved side edges 66 and 68 and the downwardly facing support shoulder 82 with the upper surface 80 of the toilet seat. Additionally, the curved side edges are rounded as is evident from FIGS. 9–11 so that the contact areas of these curved edges, with the toilet seat insert in supported engagement with the toilet seat, are recessed or set back, as shown at 81 from the rounded edges 66 and cannot normally be reached by the body tissues of the child user. These structural relationships help to minimize the possibility that the body tissues of a seated child can become located between the toilet seat and seat insert at the point or area of contact thereof. In essence, therefore, the relationship of the angulated surfaces 58 and 60 with the inner curved surface 76 of the seat 12 locates the initial contact area 70 of the support shoulder 82 with the seat surface 80 at a recessed and substantially inaccessible location. Because of this recessed location of the initial contact points it is unlikely that the body tissues of the child can become located between the seat and seat insert at these contact points and thus it is unlikely that a child can become pinched during use of the toilet seat insert.

It is desirable that the seat insert body 30 establish support and positioning with respect to the toilet seat 12 such that it is substantially immovable with respect to the toilet seat when in its lowered position as shown in FIG. 1. To accomplish this feature, side and rear edge portions of the seat insert 30 define a downwardly directed support shoulder 82 to establish supported engagement with the upper surface of the toilet seat 12 immediately about the curved inner surface 76 thereof and to define an outwardly directed locator surface or shoulder 83 that is adapted to be received in movement restraining relation with the inner curved surface 76 that defines the toilet seat opening 32 so that only minimal movement of the seat insert is allowed relative to the seat. The shoulder surface 82, when properly positioned relative to the inner curved surface 76 of the toilet seat, may be slightly spaced therefrom as shown in FIG. 9. The shoulder surface 83 will contact the curved surface 76 of the toilet seat upon minimal lateral shifting of the insert. Thus the shoulder surface 83 minimizes lateral shifting of the seat insert 30 with respect to the toilet seat 12 to insure lateral stability of the toilet seat insert when in supported engagement with the toilet seat. Though slight lateral movement of the toilet seat insert relative to the toilet seat is permissible, the shoulder surfaces 83 will contact the inner surface of the toilet seat to minimize the amount of actual movement of the insert. The wide spacing of the pivot connectors 44 and 46 also provide a restraining capability against lateral shifting of the seat insert relative to the toilet seat. The support surface 82 establishes efficient and stable support with the upper surface of the toilet seat 12 to further insure the stability of the insert with respect to the toilet seat. Additionally, the tail piece 38, being rather wide, provides the seat insert with efficient structural integrity and also assists in minimizing lateral shifting of the seat insert when it is in supported engagement with the toilet seat.

As mentioned above, it is desirable to provide for channeling of accidentally spilled liquid between the toilet seat and toilet seat insert and through the toilet seat opening into the toilet. This feature is accomplished by providing the insert with drainage channels 84 as shown by the bottom view of FIG. 2 and as shown by the partial sectional view of FIG. 10. The bottom view of FIG. 2 illustrates curved side recesses 85 and 86 that are defined by the shoulder surface 82 and the outwardly facing shoulder 83. The seat insert 30 defines a plurality of transversely oriented drain channels 84 that are located in spaced relation about the side and rear curvature of the seat insert. One of these transversely oriented liquid drain channels is illustrated in the fragmentary sectional view of FIG. 10. In the event liquid is accidentally spilled on the upper surface 80 of the toilet seat 12, it is typically directed toward the opening 32 of the toilet seat by the slope or curvature of the upper toilet seat surface. The drain channels 84 permit this accidentally spilled liquid to flow between the seat insert and the toilet seat and through the toilet seat opening 32 into the toilet for disposal. This feature minimizes soiling of the toilet seat and enhances the sanitary condition of the toilet. In the event the seat insert should become soiled so that its cleaning is necessary, a person will simply pivot the seat insert to its intermediate or other installation and removal angle and withdraw it from its pivotal connection as discussed above. After having been cleaned the seat insert can be reinstalled to its pivotal connection by orienting it to its installation angle and then positioning the pivot connections thereof onto the pivot pins or into the pivot openings as the case may be.

In view of the fact that the toilet seat insert is intended to be utilized by children of all ages, especially those that are being "potty trained" it is likely that the toilet seat insert will become soiled from time to time. As mentioned above, it is desirable that the cover for the conventional toilet seat be protected against accidental soiling. According to the scope of the present invention, this feature is effectively realized by providing a toilet seat insert shown generally at 92 defining stop means for engagement with the toilet seat cover or with the ceramic toilet and which limits rearward pivoting of the toilet seat insert so that the seat insert cannot come into contact with the toilet seat cover when the toilet seat insert is at its raised position. One suitable embodiment for accomplishing this feature may conveniently take the form of a pivoted seat assembly shown generally at 90 in FIG. 12 having a toilet seat insert shown generally at 92 having an insert body 94 that may be of essentially the same general ergonomic configuration as compared with the seat body of FIGS. 1 and 2. From the seat body 94 extends an integral elongate connection web or tail piece 96 located at the free extremity thereof which is angulated upwardly and rearwardly from the insert body 94 and having pivot connection means 98 which is oriented in downwardly and forwardly inclined relation with the free extremity 100 of the tail piece 96. At the raised position of the insert 92 the free end 100 of the tail piece will contact the upper surface 102 of the toilet fixture 104 thereby providing a stop function to limit rearward pivoting of the insert. At its raised and stopped position as shown in broken line in FIG. 13, the tail piece 96 will prevent contact of the toilet seat insert with the inner surface of the toilet seat cover. This feature effectively prevents soiling of the toilet seat cover in the event the toilet seat insert should be pivoted upwardly to its upstanding position after having been soiled.

In view of the foregoing, it is evident that the present invention is one well adapted to attain all of the objects and features hereinabove set forth, together with other objects and features which are inherent in the apparatus disclosed herein.

With the same spirit that drives the science of ergonomics to seek and adapt work or working conditions to suit the worker this invention provides a toilet seat assembly that is ergonomically designed so as to address not only the issues of effective use by people of all ages but to facilitate safe and effective use of toilet seat assemblies by a wide range of the population, including adults and children of a wide age range.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. An ergonomic adult/child toilet seat assembly for mounting on a toilet fixture and for use by adults and children, comprising:

(a) a toilet seat of a dimension for use by adults and defining a central opening;

(b) a child's toilet seat having interfitting supported engagement with said toilet seat and adapting said toilet seat for use by children by covering rear and side portions of said central opening;

(c) a pair of toilet seat pivot assemblies for supporting said toilet seat and said child's toilet seat in independently pivotal relation with said the toilet fixture and for supporting said child's toilet seat for pivotal movement thereof between a seated position in engagement with said toilet seat and an upstanding out of the way position to permit use of said toilet seat by adults, each of said toilet seat pivot assemblies having a pivot pin having a circular cross-section of a defined diameter, said toilet seat being pivotal about said circular cross-section of said pivot pins, each of said pivot pins also having a child's seat insert pivot section defining a pair of spaced parallel flat surfaces having a distance of spacing less than said defined diameter and being oriented at an angle between the horizontal and the vertical to permit assembly and removal of said child's toilet seat relative to said pivot pins only at an angular position thereof between said seated and upstanding positions; and (d) said child's toilet seat having a rigid tailpiece extending therefrom and having a pair of rigid hinge connections defining a pivot receptacle having a circular hinge opening of a dimension for rotation about said circular cross-section of said pivot pin, said rigid hinge connection having spaced internal parallel flat surfaces defining an access opening for lateral assembly and disassembly of said rigid hinge connection relative to said pivot pins when said spaced internal parallel surfaces of said hinge connection are in aligned registry with said spaced external parallel surfaces of said pivot pins, thereby permitting assembly of said child's toilet seat to said pivot pins and permitting separation of said child's toilet seat from said pivot pins by movement of said child's toilet seat in a direction transverse to said pivot pins.

2. The ergonomic adult/child toilet seat assembly of claim 1, further comprising:

a stop element being defined on said child's toilet seat and being engagable with said toilet fixture for positioning said child's toilet seat at an over-center position relative to said pivot pin when said child's toilet seat is located at said upstanding position thereof.

3. The ergonomic adult/child toilet seat assembly of claim 1, wherein said child's toilet seat comprises:

(a) a child's toilet seat body of a configuration for seating on said toilet seat at a location adjacent said central opening; and (b) said rigid tail piece projecting rearwardly from said child's toilet seat body and having said pair of said hinge connections thereon and being disposed in axially spaced relation.

4. The ergonomic adult/child toilet seat assembly of claim 3, further comprising:

(a) a toilet seat cover being pivotally connected to said pivot pins; and (b) at least one pivot element projecting laterally from said tail piece and defining a stop element, said hinge connection having a pivot connection thereon, at the upstanding position of said child's toilet seat said stop element engaging one of said toilet fixture and toilet seat and preventing pivotal movement of said child's toilet seat past said upstanding position, said stop element being oriented for stopping pivotal rotation of said child's toilet seat with said child's toilet seat in spaced relation at said upstanding position with said toilet seat cover.

5. The ergonomic adult/child toilet seat assembly of claim 1, wherein:

each of said pivot pins being in fixed relation with one of said toilet seat pivot assemblies.

6. The ergonomic adult/child toilet seat assembly of claim 1, wherein:

(a) each of said toilet seat pivot assemblies defining a pivot projection having one of said pivot pins extending therefrom; and (b) said spaced external parallel flat surfaces being located at the juncture of said pivot pin and said pivot projection.

7. The ergonomic toilet seat assembly of claim 6, wherein:

(a) said pivot pins being integral with said pivot projections; and (b) said rigid hinge connections being integral with said child's toilet seat.

8. The ergonomic toilet seat assembly of claim 1, wherein:

(a) said pivot pin being in fixed relation with said hinge assembly; and (b) said pivot connection being integral with said child's seat toilet seat.

9. The ergonomic toilet seat assembly of claim 1, wherein:

said toilet seat insert defining a plurality of drain channels for channeling liquid from said toilet seat to said central opening.

10. The ergonomic toilet seat assembly of claim 1, wherein said child's toilet seat comprising;

(a) a child's toilet seat body having an outer peripheral support flange for engagement with said toilet seat about said central opening and defining an outwardly facing shoulder for location within said central opening and limiting lateral movement of said toilet seat insert relative to said toilet seat, said child's toilet seat body further defining spaced forwardly projecting side sections and a curved forward edge extending to said forwardly projecting side sections, said child's toilet seat body further defining outwardly facing rearwardly diverging angulated side surfaces on said forwardly projecting side sections, said angulated side surfaces in said seated position of said toilet seat insert having inner ends overlying said central opening and outer ends overlying a portion of said toilet seat; and (b) said rigid tail piece projecting rearwardly from said child's toilet seat body and having a pair of said rigid pivot connections in spaced relation thereon.

11. An ergonomic adult/child toilet seat assembly for selective use by adults and children, comprising:

(a) a toilet seat for pivotal assembly with a toilet fixture and being of a dimension for use by adults and defining a central opening;

(b) a child's toilet seat having intermitting and supported relation with said toilet seat and adapting said toilet seat for use by children and having a seated position on said toilet seat and an upstanding out of the way position permitting use of said toilet seat by adults; and (c) a pair of pivot assemblies adapted for mounting on a toilet fixture for supporting said toilet seat and said child's toilet seat independently in pivotal relation with the toilet fixture and defining a pivot axis, said child's toilet seat being separable from said pair of pivot assemblies by movement thereof in a direction transverse to said pivot axis; and (d) a pivot release permitting assembly of said toilet seat insert to said pivot assemblies and permitting separation of said child's toilet seat from said pivot assemblies at a predetermined angular position of said child's toilet seat between said seated position and said upstanding position and comprising;

(1) a pivot pin of circular cross-section along a majority of the length thereof and having a defined external dimension, said pivot pin having a pivot access section defining spaced parallel flat surfaces having a spacing of less external dimension than said defined external dimension; and (2) at least one rigid pivot connection being defined by said child's toilet seat and having a pivot opening of a dimension for pivotal relation with said defined external dimension of said pivot pin and further having internal parallel flat surfaces thereon defining a pivot access opening intersecting said pivot opening and having an internal spacing dimension less than said defined external dimension and being of a dimension permitting movement of said external flat surfaces of said pivot pin through said pivot access opening to and from said pivot opening, said external parallel flat surfaces and said spaced internal parallel flat surfaces being angularly oriented with respect to said seated and upstanding positions of said child's toilet seat to permit assembly and separation of said toilet seat insert relative to said toilet seat only when oriented in predetermined angular position of said child's toilet seat between said seated and upstanding positions and preventing assembly and separation of said child's toilet seat from said pivot pin when said child's toilet seat is at either said seated position or said upstanding position.

* * * * *